US008160292B2

(12) United States Patent
Sano et al.

(10) Patent No.: US 8,160,292 B2
(45) Date of Patent: Apr. 17, 2012

(54) LOUDSPEAKER AND ELECTRONIC APPARATUS USING THE SAME

(75) Inventors: Koji Sano, Mie (JP); Kazuki Honda, Mie (JP); Masashi Kawabe, Mie (JP); Mamiko Tsutsumi, Mie (JP)

(73) Assignee: Panasonic Corporation, Osaka (JP)

( * ) Notice: Subject to any disclaimer, the term of this patent is extended or adjusted under 35 U.S.C. 154(b) by 440 days.

(21) Appl. No.: 12/065,208

(22) PCT Filed: Sep. 28, 2007

(86) PCT No.: PCT/JP2007/068954

§ 371 (c)(1),
(2), (4) Date: Feb. 28, 2008

(87) PCT Pub. No.: WO2008/038760

PCT Pub. Date: Apr. 3, 2008

(65) Prior Publication Data

US 2010/0177927 A1 Jul. 15, 2010

(30) Foreign Application Priority Data

Sep. 29, 2006 (JP) ..... 2006-267629
Apr. 12, 2007 (JP) ..... 2007-104772
Apr. 12, 2007 (JP) ..... 2007-104773

(51) Int. Cl.
*H04R 1/00* (2006.01)

(52) U.S. Cl. ..... 381/420

(58) Field of Classification Search ..... 381/420
See application file for complete search history.

(56) References Cited

U.S. PATENT DOCUMENTS 7,885,425 B2 * 2/2011 Matsumura et al. ..... 381/420
2007/0165902 A1 * 7/2007 Matsumura et al. ..... 381/396

FOREIGN PATENT DOCUMENTS

JP 5-34797 4/1993
JP 2005-051283 2/2005
JP 2006-173997 A 6/2006
JP 38-41222 B 8/2006
WO 2006/080405 A1 8/2006

OTHER PUBLICATIONS

International Search Report for PCT/JP2007/068954; Oct. 11, 2007.
Supplemental European Search Report dated Jun. 18, 2010.

* cited by examiner

*Primary Examiner* — Charles Garber
*Assistant Examiner* — Andre' C Stevenson
(74) *Attorney, Agent, or Firm* — Pearne & Gordon LLP

(57) ABSTRACT

In a loudspeaker, three magnets are disposed to provide magnetic gaps therebetween and a voice coil is fit therein. The magnets disposed at both sides are magnetized so that their opposing poles exhibit the same magnetic polarity. The magnet in the middle has its magnetic poles in the direction perpendicular to the line connecting the poles of the side magnets. The side magnets are fixed to a plate made of non-magnetic material. Those magnetic poles of the side magnets and the middle magnet not facing the magnetic gaps are magnetically coupled by a magnetic member.

9 Claims, 8 Drawing Sheets

LOUDSPEAKER AND ELECTRONIC APPARATUS USING THE SAME

TECHNICAL FIELD

The present invention relates to a slim-profile loudspeaker and an electronic apparatus which incorporates the loudspeaker.

BACKGROUND ART

Many of the portable electronic apparatuses are requested to have slim designs. So, loudspeakers built in such apparatuses are also required to have slim designs as well.

A generally practiced way of making conventional loudspeakers thinner is reducing the size of magnet which forms magnetic circuit; such as the one described in the Patent Document 1 below. The smaller-sized magnet can provide the smaller magnetic force; as the results, the sound output shrinks. Therefore, the magnet size can not be reduced very much, so that the efforts for thickness reduction with conventional loudspeakers have not yielded significant achievements.

There is another approach for improving the disadvantage due to size reduction of magnet; that is splitting a magnet into pieces and placing the split pieces of the magnet at appropriate locations. However, placing those magnetized pieces precisely at specific locations is a difficult job because each one exhibits magnetic attracting force or repelling force.

Patent Document: Japanese Patent Unexamined Publication No. 2005-51283.

SUMMARY OF THE INVENTION

A loudspeaker of slim profile which generates high sound outputs, and provides superior capabilities of withstanding vibrations and mechanical shocks. The loudspeaker in the present invention includes a first magnet, a second magnet, a third magnet, a voice coil, a diaphragm, a plate made of non-magnetic material, and magnetic member. The first magnet has a first pole and a second pole whose polarity is opposite to that of the first pole. The second magnet has a third pole of the same polarity as the first pole of the first magnet and a fourth pole of the same polarity as the second pole. These magnets are disposed so that the first pole and the third pole oppose face to face each other. The third magnet, which has a fifth pole of the same polarity as the first pole of the first magnet and a sixth pole of the same polarity as the second pole, is disposed so that the direction containing the fifth pole and the sixth pole is perpendicular to the line connecting the first pole of the first magnet and the third pole of the second magnet, and that the sixth pole is positioned at the side which is closer to the first and the third poles. The third magnet provides magnetic gap in a space formed with respect to the first magnet and a space with respect to the second magnet, respectively. The voice coil is placed to be fitting in the magnetic gaps. The diaphragm supports the voice coil thereon. The plate supports the first magnet at a portion other than the first and second poles, and the second magnet at a portion other than the third and fourth poles. The magnetic member magnetically couples the second pole with the fifth pole, and the fourth pole with the fifth pole, respectively.

In the structure as described above, a loudspeaker in the present invention implements a slim overall profile, and the magnetic flux therein crosses the voice coil in the magnetic gap at a substantially perpendicular angle. In addition, since the loudspeaker is provided with three magnets, the magnetic force is strengthened for generating higher sound outputs. Furthermore, since the first and the second magnets are fixed on the plate, the properties of withstanding vibrations and mechanical shocks are enhanced.

REFERENCE MARKS IN THE DRAWINGS

| | |
|---|---|
| 1 | Body |
| 2 | Lid |
| 3 | Cover |
| 4 | Loudspeaker |
| 4A | Case |
| 5, 6 | Plate |
| 5A | Sound Hole |
| 5B, 7A | Adhesive Agent |
| 6A | Fixing Section |
| 6B | Open Area |
| 7 | Third Magnet |
| 9 | Diaphragm |
| 9A | Top Portion |
| 9B, 9C | Side Portion |
| 9D | Barrel Portion |
| 10 | Voice Coil |
| 11 | Ring |
| 12A | First Magnet |
| 12B | Second Magnet |
| 13 | Frame |
| 14 | Magnetizing Device |
| 15 | Case |
| 16 | First Magnetizing Yoke |
| 17 | Second Magnetizing Yoke |
| 18 | Third Magnetizing Yoke |
| 16A, 17A, 18A | Coil |
| 19 | Resin |
| 20 | Holding Jig |
| 21 | Open Area |
| 22 | Platform |

-continued

| | |
|---|---|
| 23 | Base |
| 23A | Protrusion |
| 24 | Assembly Jig |
| 25 | Movable Member |
| 25A | Hollow |
| 32A | First Magnetic Substance |
| 32B | Second Magnetic Substance |
| 41 | Circuit Section |
| 42 | Input Section |
| 43 | Microphone |
| 44 | Display Section |
| 45 | Loudspeaker |

DETAILED DESCRIPTION OF PREFERRED EMBODIMENT

Figure 1:
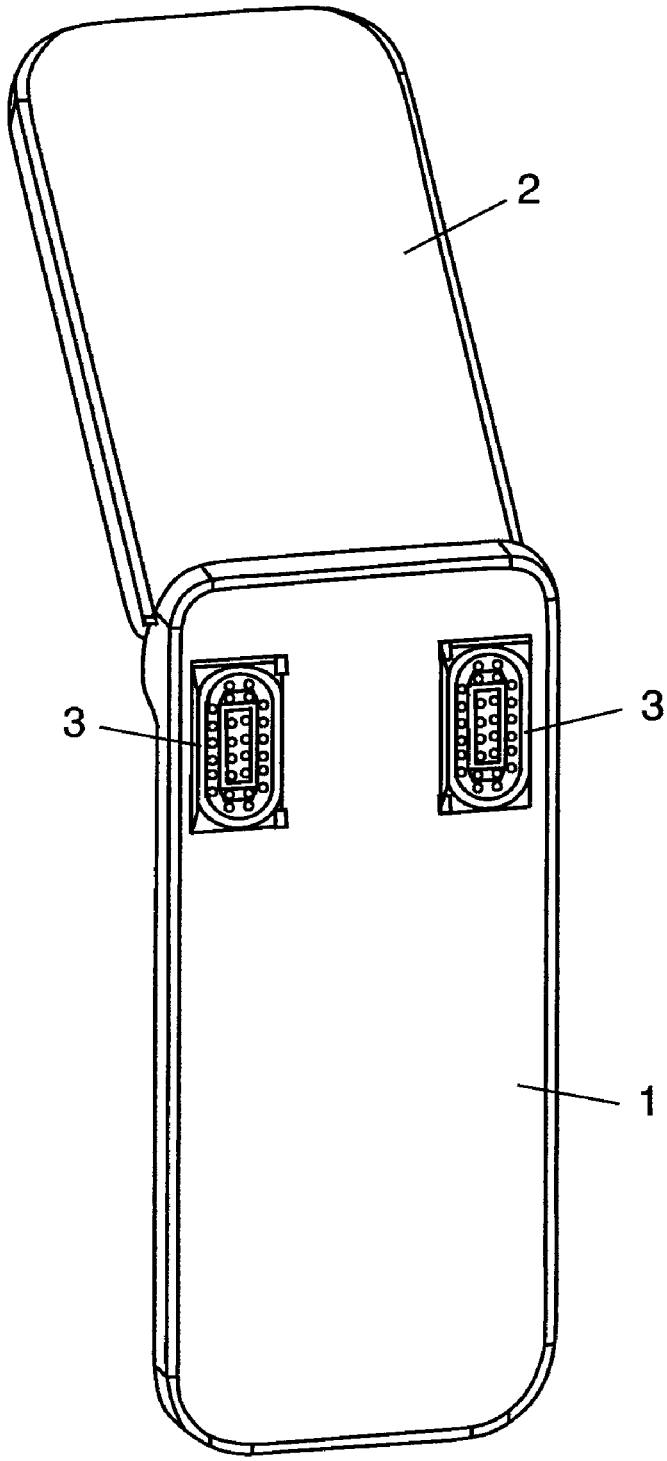
FIG. 1 is a perspective view of a mobile phone unit incorporating a loudspeaker in accordance with an exemplary embodiment of the present invention.
Figure 2A:
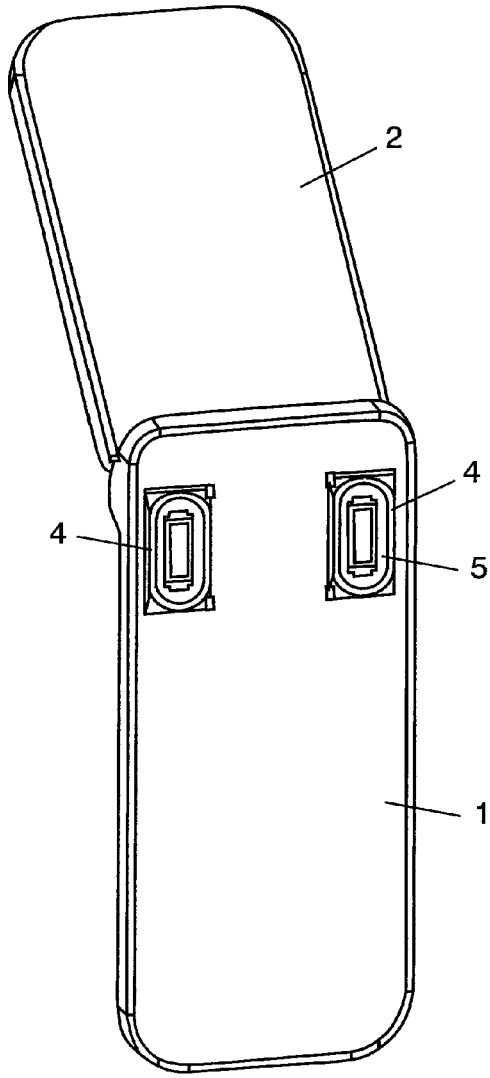
FIG. 2A is a perspective view of the mobile phone unit shown in FIG. 1, with cover removed.
Figure 2B:
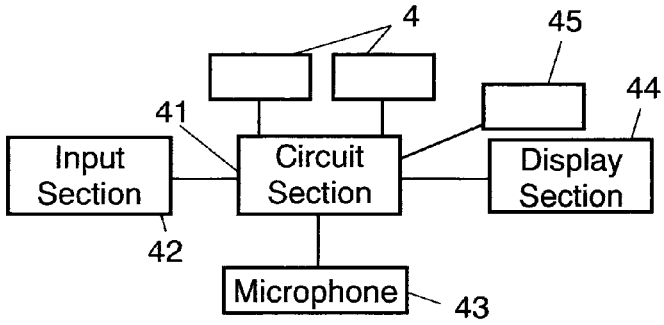
FIG. 2B shows block diagram of the mobile phone unit shown in FIG. 1.
Figure 3:
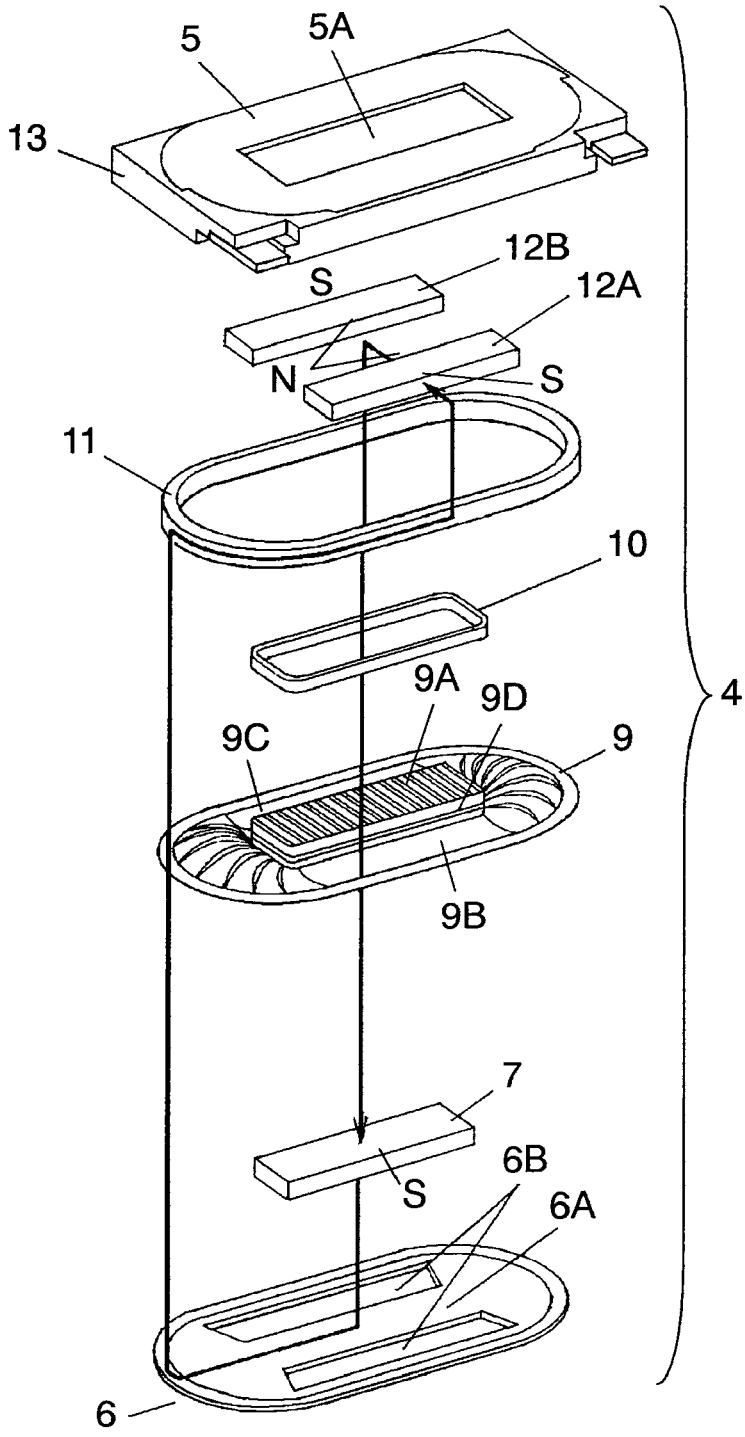
FIG. 3 is an exploded perspective view of the loudspeaker shown in FIG. 2A.
Figure 4:
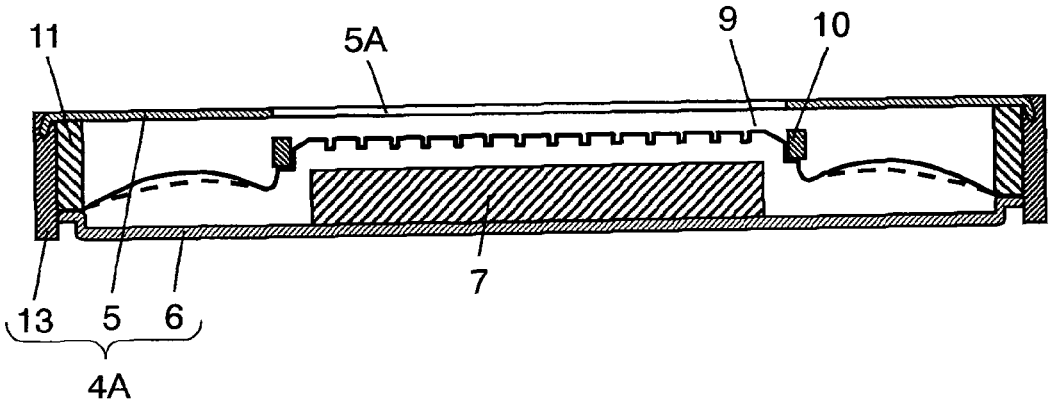
FIG. 4 is a cross sectional view of the loudspeaker shown in FIG. 2A, sectioned along the longitudinal direction.
Figure 5:
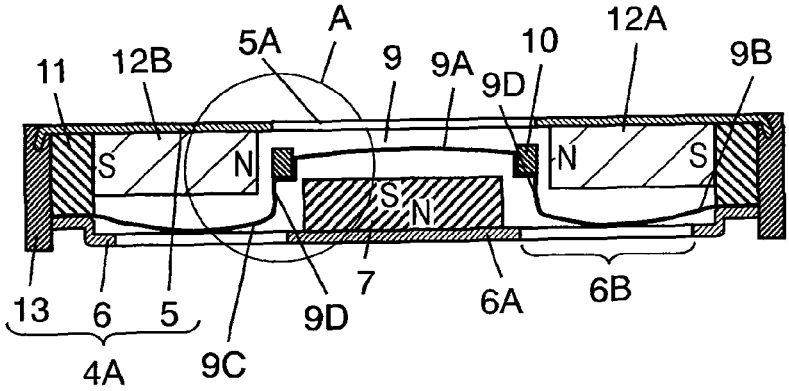
FIG. 5 is a cross sectional view of the loudspeaker shown in FIG. 2A, sectioned along the direction of shorter side.
Figure 6:
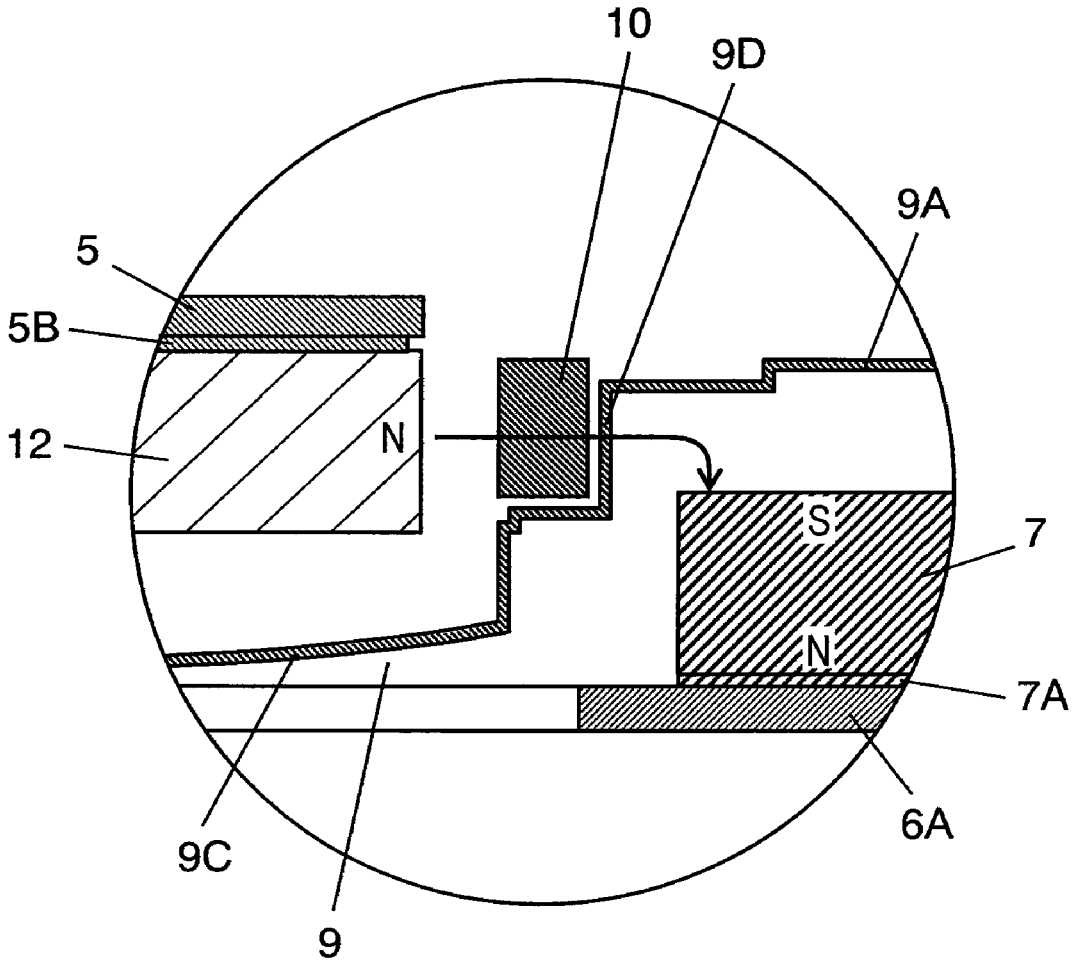
FIG. 6 is a magnified cross sectional view showing the portion A of FIG. 5.

Now in the following, an exemplary embodiment of the present invention is described referring to the drawings, using a mobile phone unit to represent an electronic apparatus. FIG. 1 is a perspective view of a mobile phone unit which contains a loudspeaker in accordance with an exemplary embodiment of the present invention. FIG. 2A is a perspective view of the mobile phone unit shown in FIG. 1, with its cover detached. FIG. 2B is block diagram of the mobile phone unit shown in FIG. 1. FIG. 3 is an exploded perspective view of the loudspeaker shown in FIG. 2A. FIG. 4 is a cross sectional view of the loudspeaker shown in FIG. 2A, sectioned along the longitudinal direction. FIG. 5 is a cross sectional view, sectioned along the direction of shorter side. FIG. 6 is a magnified cross sectional view showing the portion A of FIG. 5.

An electronic apparatus, viz. mobile phone unit, is provided at the outer surface of body 1 with two pieces of cover 3 as shown in FIG. 1. Loudspeaker 4 is mounted into body 1 at the back of cover 3, as shown in FIG. 2.

Lid 2 is attached to body 1, coupled so that the lid can be opened/dosed freely. Like other mobile phone units, body 1 has input section 42 formed of operation buttons and microphone 43, as described in FIG. 2B, at the reverse surface of illustration in FIG. 1. Lid 2 has display section 44 of LCD and loudspeaker 45 for receiving conversation. Circuit section 41 housed within body 1 receives input signal delivered from input section 42, and displays the input on display section 44 together with other incoming information, etc. During telephone conversation, circuit section 41 receives voice input signal from microphone 43, and reproduces the voices from counterpart through loudspeaker 45. Furthermore, circuit section 41 drives loudspeaker 4 for generating ringtone.

As shown in FIG. 3, loudspeaker 4 includes plates 5 and 6, first magnet 12A, second magnet 12B and third magnet 7, each of which has a platy shape, ring 11, diaphragm 9 and voice coil 10. Plate 5 which is exposed to the outside of body 1 is made of a non-magnetic material, for example, a stainless steel (e.g. SUS301), while plate 6 is made of cold rolled steel sheet, a magnetic material. The outer surface in part of plate 5 and respective outer circumferences of the constituent components are covered with resin-made frame 13, as shown in FIG. 4 and FIG. 5. Namely, plates 5, 6 and frame 13 constitute case 4A. Plate 5 has sound hole 5A.

Platy first magnet 12A, second magnet 12B and third magnet 7, each having longitudinal direction, are made of neodymium, for example. The neodymium magnet exhibits strong magnetic polarity, so it is preferable for use in the small and slim loudspeakers, like loudspeaker 4 in the present embodiment. The magnet, however, is not necessarily be a neodymium-made. What is needed for the magnet is to have strong magnetic force; it is not limited to a neodymium magnet. Each of first magnet 12A, second magnet 12B and third magnet 7 has its own N-pole and S-pole. In the following descriptions, N-pole of first magnet 12A is called as first pole while S-pole is called as second pole whose magnetic polarity is opposite to the first pole. In the same token, N-pole of second magnet 12B is third pole while S-pole is fourth pole whose magnetic polarity is opposite to the third pole. N-pole of third magnet 7 is fifth pole while S-pole is sixth pole whose magnetic polarity is opposite to the fifth pole. The polarity setting for these magnets is not limited to the above-described arrangements, but the N- and S-arrangements may be reversed with respect to the whole magnets.

Diaphragm 9 is provided using, for example, a polyetherimide film. Voice coil 10 is made of copper wire, or the like item. Projected view of voice coil 10 is an oblong shape having a couple of long sides; these long sides are arranged in the magnetic gaps provided in the longitudinal direction at both sides of third magnet 7. Ring 11 is formed of a cold rolled steel sheet, which is a magnetic material.

Third magnet 7, diaphragm 9, voice coil 10, ring 11, first magnet 12A and second magnet 12B are disposed in this order from plate 6 to plate 5 in case 4A.

As shown in FIG. 3 and FIG. 5, plate 6 has an oblong shape. It has fixing section 6A of a rectangular shape disposed in the longitudinal direction along the center axis portion (central portion). As shown in FIG. 6, third magnet 7 is fixed on the upper surface of fixing section 6A with adhesive agent 7A applied at the bottom of the magnet. Open area 6B having rectangular shape is provided a both sides of fixing section 6A t. Open areas 6B functions as a sound hole at the back, which enables loudspeaker 4 to discharge sounds also from the back.

On the outer circumference of plate 6, outer circumference of diaphragm 9 is placed allowing the magnetic flux to go through, as indicated in FIG. 3 with an arrow mark. Ring 11 is disposed on the outer circumference of diaphragm 9. In order to avoid too much complexity of the illustration, FIG. 3 shows the magnetic flux generated from first magnet 12A alone, among other magnetic fluxes.

First magnet 12A and second magnet 12B are disposed above diaphragm 9 and fixed there to be facing towards open areas 6B of plate 6, respectively. Part of adhesive agent 5B intrudes into spaces formed by respective outer circumferential surfaces of first magnet 12A, second magnet 12B and inner circumferential surfaces of ring 11 and frame 13. In this way, the respective outer circumferential surfaces of first magnet 12A and second magnet 12B are fixed also to ring 11 and frame 13 at their inner circumferential surfaces.

As shown in FIG. 3 and FIG. 5, diaphragm 9 has top portion 9A, side portions 9B, 9C and barrel portion 9D. Top portion 9A is disposed to oppose to S-pole of third magnet 7, side portion 9B to oppose to a surface of first magnet 12A other than its N-pole and S-pole, while side portion 9C to oppose to a surface of second magnet 12B other than its N-pole and S-pole. Voice coil 10 of an oblong is disposed on the upper surface of diaphragm 9 and fixed to barrel portion 9D which corresponds to the outer circumference of third magnet 7. Barrel potion 9D is disposed in the magnetic gaps formed between first magnet 12A and third magnet 7, and between second magnet 12B and third magnet 7. Consequently, voice coil 10 is also disposed in the magnetic gap. Thus, diaphragm 9 is disposed so as to separate third magnet 7 from first and second magnets 12A, 12B.

First magnet 12A and second magnet 12B are fixed to the bottom surface of plate 5 with adhesive agent 5B. In other words, plate 5 holds first magnet 12A and second magnet 12B at their portions other than their magnetic poles. Describing more specifically, plate 5 is fixed to first magnet 12A at a portion (side surface) which is parallel to direction connecting its magnetic poles. The same applies to second magnet 12B.

As shown in FIG. 6, first magnet 12A and second magnet 12B are magnetized so that their longitudinal side-surfaces opposing to each other make the N-poles, while the opposite side-surfaces make the S-poles. Namely, second magnet 12B is disposed so that its N-pole faces N-pole of first magnet 12A.

Third magnet 7 has been magnetized with its upper surface in the thickness direction making the S-pole while the lower surface making the N-pole. First magnet 12A, second magnet 12B and third magnet 7 are disposed substantially in a horizontal state. The substantially horizontal state includes the state as illustrated in FIG. 5, where first and second magnets 12A, 12B are partially overlapping with third magnet 7 in the direction of thickness, as well as a state where they are not actually overlapping in the thickness direction but are in the proximity. In this way, third magnet 7 is disposed so that the direction connecting its N-pole and S-pole is perpendicular to the direction connecting N-pole of first magnet 12A and N-pole of second magnet 12B, and S-pole of third magnet 7 is at the side closer to N-pole of first magnet 12A and N-pole of second magnet 12B. First magnet 12A, second magnet 12B and third magnet 7 are orientated so that their longitudinal directions are parallel among each other.

In the above-described arrangements, magnetic flux coming from the N-pole, which is at the inner side-surface of respective first and second magnets 12A and 12B, proceeds inwards along an approximate horizontal direction and crosses voice coil 10 substantially perpendicularly, as shown in FIG. 3 and FIG. 6. And then, it goes into the S-pole at the upper surface of third magnet 7. Namely, when first magnet 12A, second magnet 12B and third magnet 7 are disposed in the horizontal state, the magnetic flux proceeds to cross voice coil 10 substantially perpendicularly. In this respect, the horizontal state may be given with some margin of tolerance. Then the magnetic flux, after going through the lower surface, or the N-pole, of third magnet 7, proceeds along fixing section 6A of plate 6 to enter into ring 11 via the outer circumference of diaphragm 9. And then the magnetic flux enters into the S-pole locating at the outer side-surface of first magnet 12A, second magnet 12B fixed to the inner circumference of ring 11, after traveling through ring 11 for e.g. a quarter of a round.

The above-described flow route of magnetic flux represents a magnetic circuit. In the magnetic circuit, a space formed between the N-pole, which is at the inner side-surfaces of first magnet 12A and second magnet 12B, and the S-pole, which is at the upper surface of third magnet 7 makes magnetic gap. The magnetic gap provides voice coil 10 with electromagnetic field force, and diaphragm 9 which has been fixed to voice coil 10 is vibrated for generating sound outputs.

Now In the following, traveling path of magnetic flux at the magnetic gap is described once again. As shown in FIG. 3 and FIG. 6, magnetic flux coming out of the N-pole at the inner side-surface of first magnet 12A and second magnet 12B, respectively, goes through the magnetic gap towards inside along approximately horizontal direction and crosses voice coil 10 substantially perpendicularly. This is a point of significant importance from the view of increasing the driving force of electromagnetic field, and constitutes a major feature point of the present embodiment.

Now, the reason why the magnetic flux proceeds along the substantially horizontal direction in the magnetic gap and crosses voice coil 10 substantially perpendicularly is deliberated on.

The magnetic flux coming from the N-pole of first magnet 12A and second magnet 12B is generally considered to go obliquely towards the S-pole at the upper surface of third magnet 7. In this case, the magnetic flux slightly crosses voice coil 10 obliquely. Actually, however, the magnetic flux is uplifted by repelling force due to the N-pole which locates at the lower surface of third magnet 7, and goes through the magnetic gap towards inside along the substantially horizontal direction, as illustrated in FIG. 6. Therefore, the magnetic flux is considered to cross voice coil 10 in a substantially perpendicular state.

As described in the above, magnetic gaps in the present embodiment are provided at their both sides with first magnet 12A and third magnet 7, and second magnet 12B and third magnet 7, respectively. As the results, so-called magnetic force is enhanced, and diaphragm 9 generates greater sound outputs. Furthermore, since each of these first magnet 12A, second magnet 12B and third magnet 7 is platy shaped and thin in the thickness, the overall thickness of loudspeaker 4 can be reduced significantly.

Furthermore, first magnet 12A and second magnet 12B are fixed firm at their upper surface of large surface area with the lower surface of plate 5 using adhesive agent 5B. So, the strength against vibration and shock given to case 4A are enhanced. Third magnet 7 is fixed at the lower surface, which also has a large surface area, onto the upper surface of plate 6 using adhesive agent 7A. This also contributes to the enhancement of strength against vibrations and shocks exerted on case 4A.

Since plate 5 is made of a non-magnetic material, it does not cause a magnetic short-circuit phenomenon although it entirely covers the upper surfaces of first magnet 12A and second magnet 12B whose side-surfaces make the N-pole and the S-pole. Meanwhile, since plate 6 is made of a magnetic material, it does not disturb the formation of magnetic circuit shown in FIG. 3 although it covers the entire bottom surface of third magnet 7 whose upper surface and bottom surface make the S-pole and the N-pole, respectively. Rather, plate 6 functions together with ring 11 to magnetically couple the S-pole of first magnet 12A with the N-pole of third magnet 7, and the S-pole of second magnet 12B with the N-pole of third magnet 7. Thus, no unwanted magnetic gap would be formed in the magnetic circuit.

Plate 6 has open areas 6B. Because of these areas, barrel portion 9D, or the edge portion of diaphragm 9, does not hit plate 6 when diaphragm 9 vibrates. Open areas 6B secure a vibration space for barrel portion 9D. This helps making loudspeaker 4 thinner. Furthermore, since the structure helps making the distance between magnet 7 and magnet 12 shorter, the magnetic flux density is increased. This would make up for the deterioration of flux density caused as a result of the thickness reduction.

Although plate 5 in the present embodiment holds both of first magnet 12A and second magnet 12B, plate 5 may be split into two sections so that first magnet 12A and second magnet 12B are held respectively by the split sections. In this configuration, a gap between the sections functions as sound hole. However, the structure where plate 5 is provided covering the entire diaphragm 9 and both of first magnet 12A and second magnet 12B are held by plate 5 is easier to manufacture.

Loudspeaker 4 may be assembled and built direct in an electronic apparatus without employing frame 13. However, the procedure of forming case 4A using frame 13 is easier for the assembling.

Figure 7:
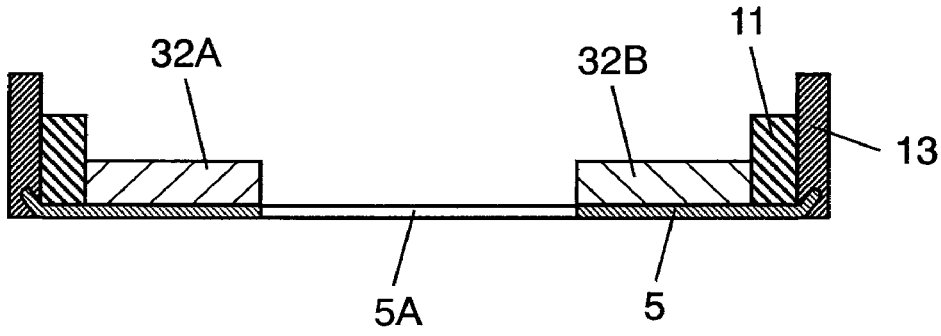
FIG. 7 is a cross sectional view showing the vicinity of plate, used to describe a step of manufacturing the loudspeaker shown in FIG. 2A.
Figure 8:
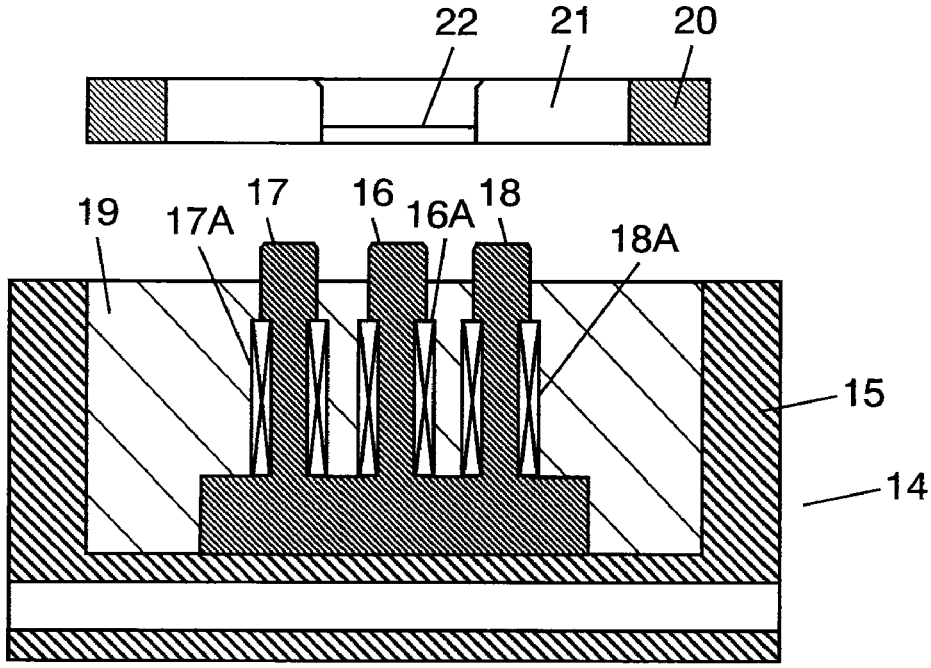
FIG. 8 is a cross sectional view, which shows a magnetizing device and a holding jig used to manufacture the loudspeaker of FIG. 2A.

Now in the following, description will be made on a method of building the component which is structured of first magnet 12A, second magnet 12B and third magnet 7 in accordance with the present embodiment. First, fix first magnet 12A and second magnet 12B on plate 5 with a specific space between the two. The specific space means a space that can still afford magnetic gap after third magnet 7 is inserted, which magnet 7 being covered by diaphragm 9 integrated with voice coil 10. However, it is not easy to dispose first magnet 12A and second magnet 12B precisely at specific location, because of influence of magnetic attracting force or repelling force. So, it is preferred to dispose first magnet 12A and second magnet 12B through the following procedure. FIG. 7 is a cross sectional view showing the vicinity of plate 5 during manufacturing of loudspeaker 4. FIG. 8 is a cross sectional view of magnetizing device and holding jig used to manufacture loudspeaker 4, and FIG. 9 shows their plan view.

Turn plate 5 fixed with frame 13 upside down, as shown in FIG. 7. Dispose ring 11 in the inside of frame 13. Place un-magnetized first magnetic substance 32A and second magnetic substance 32B on plate 5 inside ring 11, so that they oppose to each other with a certain specified clearance between the two, and fix them thereon using adhesive agent 5B.

Make part of adhesive agent 5B intrude into respective gaps between the outer circumference of first magnetic substance 32A, second magnetic substance 32B and the inner circumference of ring 11, frame 13. By so doing, the respective outer circumferential surfaces of first magnetic substance 32A and second magnetic substance 32B are fixed also to ring 11 and frame 13.

Figure 9:
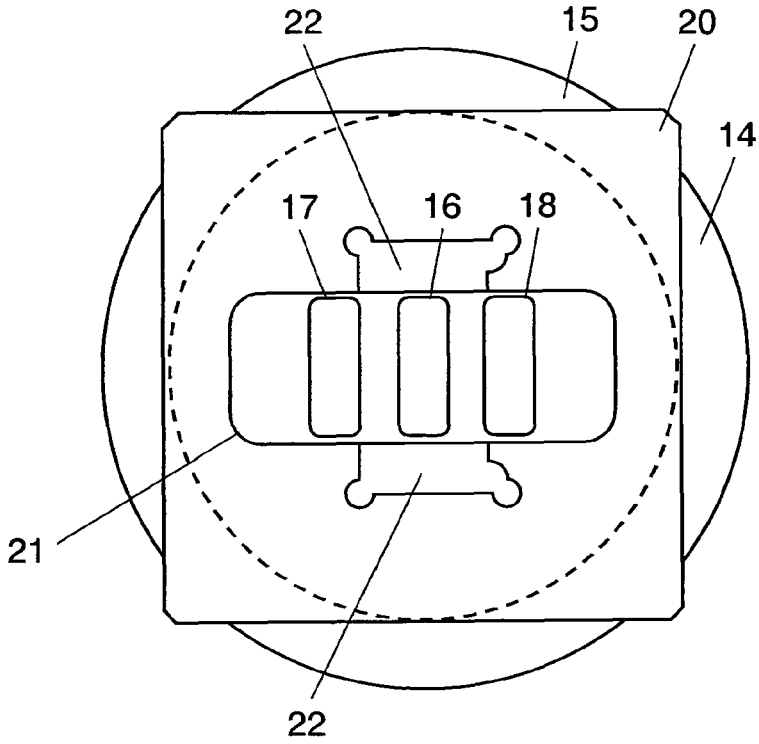
FIG. 9 is a plan view showing the magnetizing device and the holding jig of FIG. 8.

Next, set an assembled component of plate 5, ring 11, first magnetic substance 32A, second magnetic substance 32B and frame 13 shown in FIG. 7 on magnetizing device 14, as illustrated in FIG. 8 and FIG. 9. Using magnetizing device 14, magnetize the inner side-surfaces of first magnetic substance 32A and second magnetic substance 32B into the N-pole, while the outer side-surfaces into the S-pole. Namely, make the surface of first magnetic substance 32A opposing to second magnetic substance 32B into the N-pole, while the opposite surface into the S-pole; make the surface of second magnetic substance 32B opposing to first magnetic substance 32A into the N-pole, while the opposite surface into the S-pole. Thus first magnet 12A and second magnet 12B are provided.

Magnetizing device 14 includes case 15, and first magnetizing yoke 16, second magnetizing yoke 17 and third magnetizing yoke 18 (hereinafter, these will be referred to as yoke) provided upright in case 15 with specific intervals. Dispose yoke 16 between first magnetic substance 32A and second magnetic substance 32B. Dispose yoke 17 at the side of first magnetic substance 32A that is opposite to yoke 16; dispose yoke 18 at the side of second magnetic substance 32B that is opposite to yoke 16. Yokes 16, 17, 18 are wound around respectively with coils 16A, 17A, 18A. Coil 16A is wound in the direction that is opposite to that of coils 17A and 18A. Consequently, when coils 16A, 17A, 18A are supplied with electricity, upper part of yoke 16 is magnetized into the N-pole, while the upper parts of yokes 17, 18 are magnetized into the S-pole. During the magnetizing operation, yoke 16 represents a polarity that is opposite to that of yokes 17, 18.

Yokes 16, 17, 18 and coils 16A, 17A, 18A are covered with resin 19 in the inside of case 15, protruding only the upper part of yokes 16, 17, 18 above resin 19.

Figure 10:
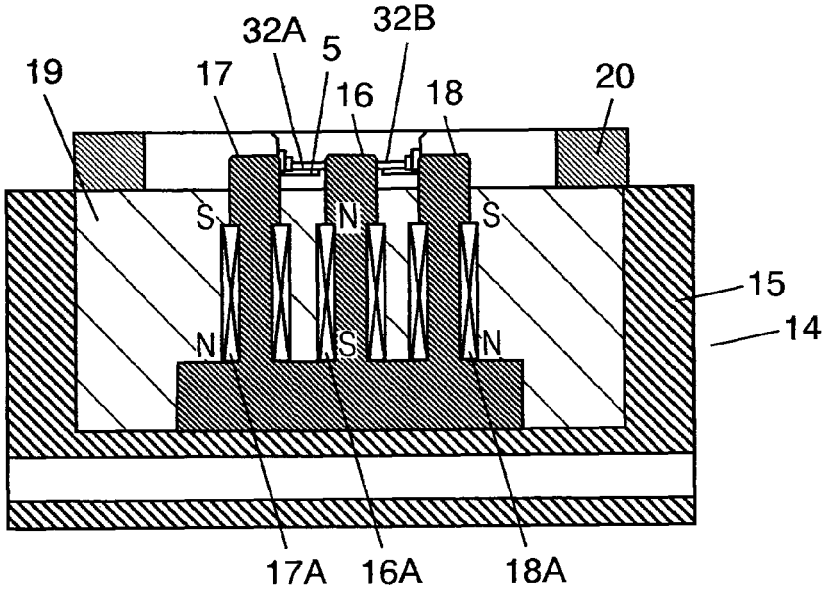
FIG. 10 is a cross sectional view used to describe how the magnetizing device and the holding jig of FIG. 8 are used.

Place holding jig 20 on case 15 at the upper surface. As FIG. 9 shows, holding jig 20 has a square-shaped projected view, and has open area 21 for allowing the upper part of yokes 16, 17, 18 to come in. Platform 22 is provided in the direction perpendicular to open area 21. Set both ends in the longitudinal direction of the assembled component of plate 5, ring 11, first magnetic substance 32A, second magnetic substance 32B and frame 13 (ref. FIG. 7) on platform 22, as illustrated in FIG. 10.

In this state, the upper end of yoke 16 comes in through sound hole 5A of plate 5 to be getting close to, or making contact with, the inner side-surfaces of first magnetic substance 32A and second magnetic substance 32B. At the outside of frame 13, yokes 17, 18 are in the proximity to the outer side-faces of first magnetic substance 32A, second magnetic substance 32B.

When coils 16A, 17A, 18A in this arrangement are activated with magnetizing current, the upper part of yoke 16 is made into the N-pole, while the upper part of yokes 17, 18 are made into the S-pole, as already described. Thereby, the inner side-surfaces of first magnetic substance 32A and second magnetic substance 32B are made into the N-pole, while the outer side-surfaces into the S-pole.

As described in the above, first magnetic substance 32A and second magnetic substance 32B are disposed on plate 5 with a specific clearance, and then these are magnetized to have the magnetic pole formed at the inner side-surfaces. In other words, first magnetic substance 32A and second magnetic substance 32B have not been magnetized yet when they are disposed on plate 5. There is neither magnetic attracting force nor magnetic repelling force at the time when they are placed on plate 5. Therefore, first magnetic substance 32A and second magnetic substance 32B can be disposed and fixed precisely at their specific locations on plate 5 with ease. First magnetic substance 32A and second magnetic substance 32B can be fixed firm on plate 5 using adhesive agent 5B.

Furthermore, since first magnetic substance 32A and second magnetic substance 32B are not magnetized, they do not attract foreign magnetic items inadvertently, and can be managed or stored with ease. Still further, these un-magnetized first magnetic substance 32A and second magnetic substance 32B may be disposed on plate 5 without paying attention to the magnetic polarity.

First magnetic substance 32A and second magnetic substance 32B are magnetized only after they are disposed and fixed firm on plate 5. Therefore, even though the opposing inner side-surfaces of first magnet 12A and second magnet 12B are of the same magnetic polarity, the first and the second magnets would not be peeled off from plate 5 or displaced by repelling force. This significantly improves the efficiency of manufacturing process.

Next descriptions will be on the assembling of the assembled component of plate 5, ring 11, first magnet 12A, second magnet 12B and frame 13, and diaphragm 9 and plate 6. In the present example, dispose third magnet 7 so that its N-pole to S-pole direction is perpendicular to the direction connecting the N-pole of first magnet 12A and the N-pole of second magnet 12B. Third magnet 7 is positioned so that its S-pole is at the side closer to the N-poles of first magnet 12A and second magnet 12B. Provide the magnetic gap at respective spaces between first magnet 12A and third magnet 7, and between second magnet 12B and third magnet 7. Place diaphragm 9 integrated with voice coil 10 on plate 5 so that voice coil 10 fits in the magnetic gap. Magnetically couple the S-pole of first magnet 12A with the N-pole of third magnet 7, and the S-pole of second magnet 12B with the N-pole of third magnet 7.

When disposing third magnet 7 into a space formed between first magnet 12A and second magnet 12B, however, third magnet 7 is exposed to magnetic attracting force, or repelling force, due to first magnet 12A and second magnet 12B. Thus, it is not an easy job to dispose third magnet 7 at a certain specified position in a space between first magnet 12A and second magnet 12B.

Figure 11:
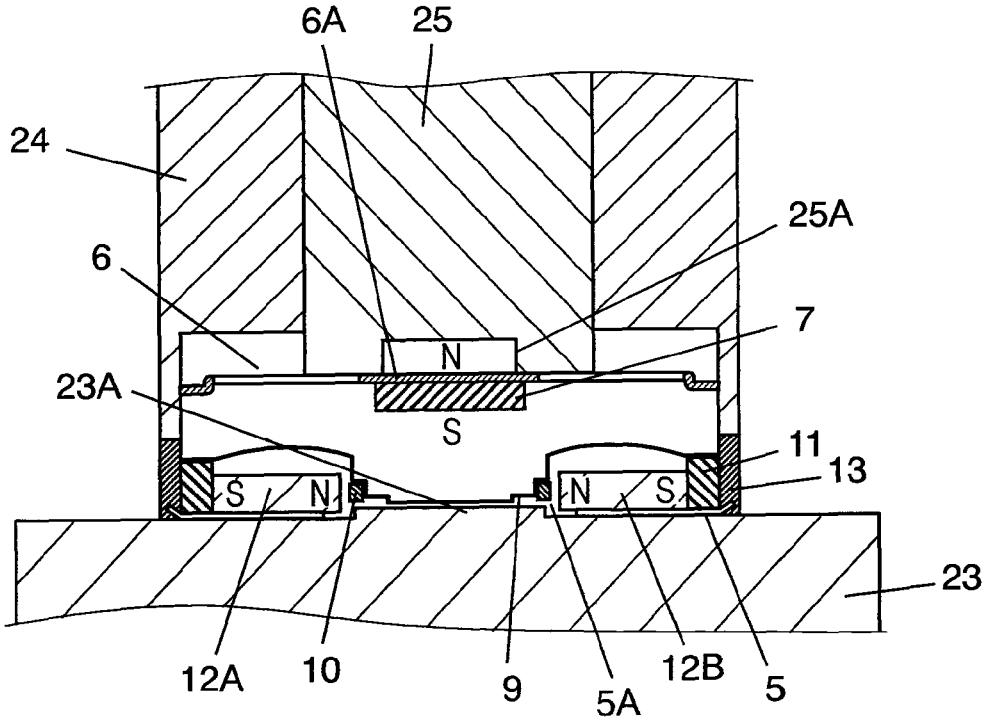
FIG. 11 is a cross sectional view used to describe a step of assembling the loudspeaker shown in FIG. 2A.
Figure 12:
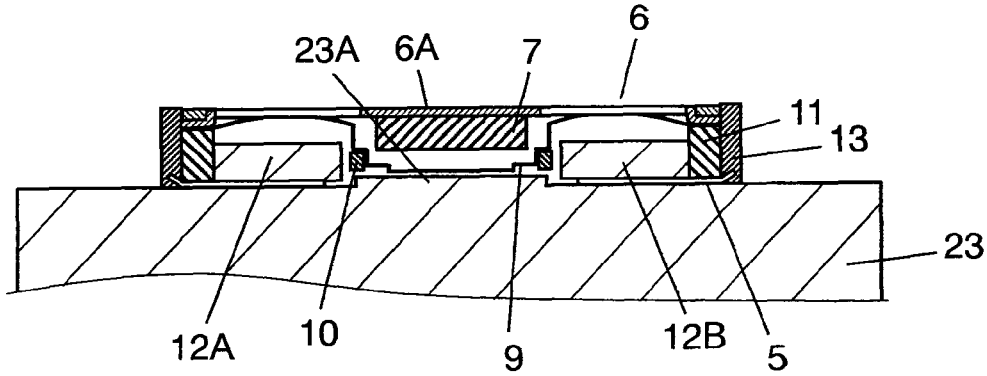
FIG. 12 is a cross sectional view used to describe an assembling step which comes subsequent to the step of FIG. 11.

So, the following procedures are preferred. FIG. 11 and FIG. 12 are cross sectional views used to describe the steps of manufacturing loudspeaker 4. First, fix voice coil 10 to diaphragm 9 for unitization. And, fix third magnet 7 on fixing section 6A of plate 6 with adhesive agent 7A for unitization. At this stage, set the assembled component of plate 5, ring 11, first magnet 12A, second magnet 12B and frame 13 on base 23 with plate 5 down, as shown in FIG. 11. Base 23 is made of iron or other magnetic material, and provided integrally on the upper surface with protrusion 23A which fits to sound hole 5A.

Set diaphragm 9 on ring 11. And then, place the bottom end of assembly jig 24 on frame 13, as illustrated in FIG. 11. Assembly jig 24 has built-in movable member 25 which is made of iron or other magnetic material and can move freely ups and downs. Movable member 25 is provided on the bottom surface at the place corresponding to third magnet 7 with hollow 25A whose projected area on plate 6 being smaller than that of third magnet 7.

Meanwhile, set plate 6 at the bottom end of movable member 25 with third magnet 7 down. Third magnet 7 had been magnetized so that the surface at plate 6 side to be the N-pole while the opposite surface to be the S-pole, before it is fixed onto the lower surface of plate 6 using adhesive agent 7A. Therefore, plate 6 is attached magnetically to the bottom surface of movable member 25 by the magnetic force of third magnet 7.

When movable member 25 is lowered, plate 6 leaves off the bottom end of movable member 25 just before the lower surface of plate 6 makes contact with the upper surface of diaphragm 9. This is caused by the magnetic pulling force due to third magnet 7, which became stronger at protrusion 23A side of the base 23 than at the movable member 25 side. In this way, plate 6 moves onto the upper surface side of diaphragm 9, as shown in FIG. 12.

In order to cause the transfer of plate 6 by taking advantage of a difference in the magnetic pulling force, base 23 is provided with protrusion 23A while movable member 25 is provided with hollow 25A. For example, by making the volume of hollow 25A to be greater than the volume of protrusion 23A, the magnetic attracting force due to third magnet 7 becomes to be greater with respect to protrusion 23A side of the base 23 rather than with the movable member 25 side.

During lowering of plate 6, third magnet 7 is exposed to certain forces caused by magnetic attraction due to first magnet 12A and second magnet 12B. These forces tend to displace third magnet 7 towards the direction of first magnet 12A or second magnet 12B. This happens because third magnet 7 has been magnetized into the N-pole at the plate 6 side and the opposite side into the S-pole, whereas the inner side-surfaces of first magnet 12A and second magnet 12B have the N polarity. However, such a displacement hardly occurs, because assembly jig 24 is provided at the inner surface with a means to restrict such a horizontal displacement. So, it is placed at an appropriate location, as illustrated in FIG. 12. Namely, assembly jig 24 has at its inner surface a restriction wall (not shown) for restricting displacement of plate 6 in horizontal direction.

After plate 6 left the bottom end of movable member 25, and moved onto the upper-surface side of diaphragm 9 as shown in FIG. 12, assembly jig 24 and movable member 25 are lifted upward. Thus, third magnet 7 is placed so that the N-pole and the S-pole direction is perpendicular to a direction connecting the N-pole of first magnet 12A and the N-pole of second magnet 12B. At the same time, third magnet 7 is positioned with its S-pole at the side closer to the N-pole of first magnet 12A and second magnet 12B.

In this way, a structure of magnets orientation is completed so that first magnet 12A, second magnet 12B and third magnet 7 are disposed with their respective longitudinal sides facing each other as viewed from the magnetizing direction of third magnet 7. Also, magnetic gaps are formed between first magnet 12A and third magnet 7, and between second magnet 12B and third magnet 7, and diaphragm 9 can be placed on plate 5 fitting voice coil 10 in the magnetic gap. Namely, the longitudinal sides of voice coil 10, which has an oblong shape as viewed from the magnetizing direction of third magnet 7, are disposed in the magnetic gap.

Finally, fix plate 6 to frame 13 using an adhesive agent. This magnetically couples the S-pole of first magnet 12A with the N-pole of third magnet 7, and the S-pole of second magnet 12B with the N-pole of third magnet 7. The assembling operation thus completes.

In the present exemplary embodiment, third magnet 7 is fixed on plate 6 at the central fixing section 6A with its N-pole making contact with the plate. On the other hand, diaphragm 9 fixing voice coil 10 is placed on plate 5, which has been mounted with first magnet 12A and second magnet 12B at specific intervals, at the first and second magnets side. And then, plate 6 is disposed so that it opposes plate 5 from above diaphragm 9, and they are made to get closer. Third magnet 7 is placed between first magnet 12A and second magnet 12B, providing magnetic gaps between first magnet 12A and third magnet 7, and second magnet 12B and third magnet 7, respectively. At the same time, voice coil 10 is disposed in the magnetic gap. In the present assembling procedure, third magnet 7 has been fixed to plate 6. So, third magnet 7 can be placed with ease at a certain specified location, despite the magnetic attracting force, or repelling force of first magnet 12A and second magnet 12B. As a result, this improves manufacturing productivity.

Plate 5 is provided with sound hole 5A of an rectangular shape to have diaphragm 9 exposed to the outside. The sound hole shape is not limited to the above-described. Instead, the hole may be formed of a plurality of small round perforations. In this case, however, the shape of sound hole 5A needs to be substantially matching with the plan views of yoke 16 and protrusion 23A in order to engage yoke 16 and protrusion 23A of base 23 to sound hole 5A. So, the rectangular shape, for example, as described in the present embodiment is preferred.

INDUSTRIAL APPLICABILITY

A loudspeaker in the present invention has three magnets which are disposed on the same horizontal plane or in a substantially horizontal direction. The magnets provide magnetic gaps in between the magnets for fitting a voice coil M. Under such arrangements, magnetic flux crosses the voice coil at a substantially perpendicular angle even in a case where the used magnets have thin plate shapes. As the results, a loudspeaker can be designed in a slim profile, yet it can generate increased sound outputs because of the increased magnetic force. In addition, since first and second magnets are fixed on a plate made of non-magnetic material, the loudspeaker exhibits the property of high withstanding capability against vibrations and mechanical shocks. The loudspeakers having such performance specifications would demonstrate some advantages when use in portable telephone units and the like electronic apparatus, among other application fields.

The invention claimed is:

1. A loudspeaker comprising a first magnet having a first pole and a second pole, the polarity of the second pole being opposite to that of the first pole;

a second magnet having a third pole of the same polarity as the first pole and a fourth pole of the same polarity as the second pole, the second magnet being disposed so that the third pole opposes the first pole face to face;

a third magnet having a fifth pole of the same polarity as the first pole and a sixth pole of the same polarity as the second pole, the third magnet being disposed so that the direction containing the fifth pole and the sixth pole is perpendicular to the line connecting the first pole and the third pole, the sixth pole is positioned at the side that is closer to the first and the third poles, and provides magnetic gaps in a space formed with respect to the first magnet and with respect to the second magnet, respectively;

a voice coil disposed in the magnetic gaps;

a diaphragm supporting the voice coil;

a plate made of non-magnetic material, the plate supporting the first magnet at a portion other than the first and the second poles, and a second magnet at a portion other than the third and the fourth poles; and a magnetic member magnetically coupling the fifth pole with the second pole and with the fourth pole, respectively.

2. The loudspeaker according to claim 1, wherein the first magnet, the second magnet, the third magnet and the voice coil are disposed so that magnetic flux crosses the voice coil at a substantially perpendicular angle.

3. The loudspeaker according to claim 1, wherein the first magnet is provided with a surface plane at a portion other than the first pole and the second pole, the second magnet is provided with a surface plane at a portion other than the third pole and the fourth pole, the first and the second magnets are fixed on the plate at the respective surface planes.

4. The loudspeaker according to claim 3, wherein the plate covers the diaphragm.

5. The loudspeaker according to claim 4, wherein the plate is provided with a sound hole opposing to the diaphragm.

6. The loudspeaker according to claim 1, wherein the third magnet is provided at the fifth pole with a surface plane, and fixed to the magnetic member at the surface plane.

7. The loudspeaker according to claim 1, wherein the plate and the magnetic member make up a case, and the first magnet, the second magnet, the third magnet, the voice coil and the diaphragm are housed in the case.

8. The loudspeaker according to claim 1, wherein the first magnet, the second magnet and the third magnet have plate shapes each having longer sides, the first magnet, the second magnet and the third magnet are orientated so that their longer sides are in parallel to each other, the voice coil in a plan view has an oblong-circle shape having a couple of longitudinal sides, and is disposed in magnetic gaps at both sides of the third magnet, in a state where the longitudinal sides fit in the magnetic gaps.

9. An electronic apparatus incorporating the loudspeaker according to claim 1 and a circuit for driving the loudspeaker.

* * * * *

UNITED STATES PATENT AND TRADEMARK OFFICE

CERTIFICATE OF CORRECTION

PATENT NO. : 8,160,292 B2
APPLICATION NO. : 12/065208
DATED : April 17, 2012
INVENTOR(S) : Koji Sano et al.

It is certified that error appears in the above-identified patent and that said Letters Patent is hereby corrected as shown below:

In column 10, line 55, please delete "M" at the end of the line and instead insert --in--.

Signed and Sealed this
Seventh Day of August, 2012

David J. Kappos

David J. Kappos
*Director of the United States Patent and Trademark Office*